US006676269B1

(12) United States Patent
Dorney

(10) Patent No.: US 6,676,269 B1
(45) Date of Patent: Jan. 13, 2004

(54) GLOW CUP SYSTEM

(75) Inventor: Peter Dorney, Casselberry, FL (US)

(73) Assignee: Glowbal, Inc., Beaufort, SC (US)

( * ) Notice: Subject to any disclaimer, the term of this patent is extended or adjusted under 35 U.S.C. 154(b) by 0 days.

(21) Appl. No.: 10/261,729

(22) Filed: Oct. 1, 2002

(51) Int. Cl.[7] ..... F21K 2/06; F21V 33/00

(52) U.S. Cl. ..... 362/34; 362/101

(58) Field of Search ..... 362/34, 96, 101, 362/154, 318; 206/217, 219, 430, 220, 568; 220/501, 506

(56) References Cited

U.S. PATENT DOCUMENTS 4,941,590 A * 7/1990 Pantaleo et al. ..... 362/101
5,671,998 A * 9/1997 Collet ..... 362/34
6,062,380 A * 5/2000 Dorney ..... 362/101

* cited by examiner

*Primary Examiner*—Y. My Quach-Lee
(74) *Attorney, Agent, or Firm*—Edward P. Dutkiewicz

(57) ABSTRACT

A glow cup system has an inner cup with an outwardly extending lip adjacent its open top and a circular base adjacent its closed bottom with an upwardly extending recess. An outer cup is coupled to an outwardly extending lip of the inner cup. A first chemiluminescent fluid is retained within an enclosed space formed between the inner and outer cups. A first chemiluminescent fluid adapted to be retained within the enclosed space. An ampule containing a second chemiluminescent fluid is positioned within the enclosed space adjacent to the recess in the closed bottom of the inner cup.

4 Claims, 3 Drawing Sheets

FIG 3
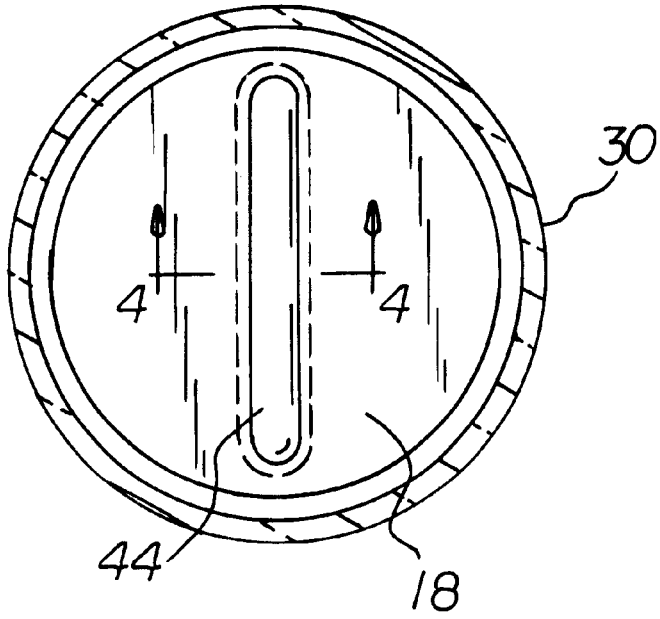
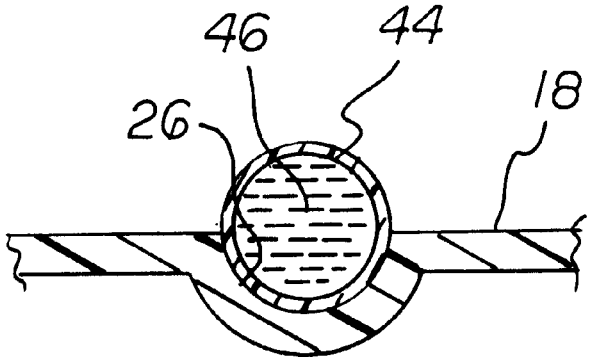
FIG 4

GLOW CUP SYSTEM

BACKGROUND OF THE INVENTION

1. Field of the Invention

The present invention relates to a glow cup system and more particularly pertains to illuminating cups for providing an attractive appearance.

2. Description of the Prior Art

The use of cups and glowing devices of known designs and configurations is known in the prior art. More specifically, cups and glowing devices of known designs and configurations previously devised and utilized for the purpose of adorning containers and other objects for improving their appearance by known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,171,081 to Pita et al. discloses a chemiluminescent reactive vessel. U.S. Pat. No. 3,354,828 to Shefler et al. disclsoes an emergency light unit. U.S. Pat. No. 3,735,113 to Stott discloses an optical display. U.S. Pat. No. 4,064,428 to Van Zandt discloses a chemical light device. U.S. Pat. No. 4,379,320 to Mohan et al. discloses a chemical lighting device. U.S. Pat. No. 4,563,726 to Newcomb et al discloses an illuminated chemiluminescent drinking mug. U.S. Pat. No. 4,814,949 to Ellott discloses a chemiluminescent device. U.S. Pat. No. 5,018,450 to Smith discloses a luminescent paintball for marking nighttime impacts. U.S. Pat. No. 5,044,509 to Petrosky et al. discloses an infant nursing bottle and luminescent indicator. U.S. Pat. No. 5,067,051 to Ladyjensky discloses a chemiluminescent lighting element. U.S. Pat. No. 6,254,247 to Carson discloses illuminable containers and method. U.S. Pat. No. 6,247,995 to Bryan discloses bioluminescent novelty items. U.S. Pat. No. 6,152,358 to Bryan discloses bioluminescent novelty items. U.S. Pat. No. 6,113,886 to Bryan discloses bioluminescent novelty items. U.S. Pat. No. 6,062,380 to Dorney discloses a glow cup system. U.S. Pat. No. 5,671,998 to Collet discloses and assembly device combining a container and a chemiluminescent light source. Finally, U.S. Pat. No. 5,609,409 to Diehl discloses a chemiluminescent stemmed drinking glass.

While these devices fulfill their respective, particular objectives and requirements, the aforementioned patents do not describe a glow cup system that allows illuminating cups for providing an attractive appearance.

In this respect, the glow cup system according to the present invention substantially departs from the conventional concepts and designs of the prior art, and in doing so provides an apparatus primarily developed for the purpose of illuminating cups for providing an attractive appearance.

Therefore, it can be appreciated that there exists a continuing need for a new and improved glow cup system which can be used for illuminating cups for providing an attractive appearance. In this regard, the present invention substantially fulfills this need.

SUMMARY OF THE INVENTION

In view of the foregoing disadvantages inherent in the known types of cups and glowing devices of known designs and configurations now present in the prior art, the present invention provides an improved glow cup system. As such, the general purpose of the present invention, which will be described subsequently in greater detail, is to provide a new and improved glow cup system and method which has all the advantages of the prior art and none of the disadvantages.

To attain this, the present invention essentially comprises a generally cylindrical inner cup with flexibility. The inner cup has an open top and a closed bottom. The inner cup also has an outwardly extending lip adjacent the open top. An upwardly extending cylindrical exterior portion adjacent to the outwardly extending lip forms the open top. A circular base defining the closed bottom has an upwardly extending recess. The recess is in latitudinal semi=cylindrical configuration.

Next provided is a generally cylindrical outer cup with limited flexibility. The outer cup has an open top and a closed bottom. The open top is coupled to the outwardly extending lip of the inner cup thereby forming an area of coupling between the inner cup and the outer cup being out of contact with liquid supported in the cup. The coupling is selected from the class of permanent couplings including a spin weld, sonic weld and adhesive. The outer cup is sized with respect to the inner cup to define an enclosed space between the inner and outer cups.

A first chemiluminescent fluid is next provided. The first chemiluminescent fluid is adapted to be retained within the enclosed space defined by the combination of the inner cup and the outer cup. Next, a cylindrically shaped ampule is provided. The ampule is positioned within the enclosed space adjacent to the recess in the closed bottom of the inner cup. The ampule contains a second chemiluminescent fluid. When the ampule is broken by compression of the outer cup on the ampule, the second chemiluminescent fluid will mix with the first chemiluminescent fluid producing a glowing chemiluminescent reaction.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved glow cup system which has all of the advantages of the prior art cups and glowing devices of known designs and configurations and none of the disadvantages.

It is another object of the present invention to provide a new and improved glow cup system which may be easily and efficiently manufactured and marketed.

It is further an object of the present invention to provide a new and improved glow cup system which is of durable and reliable constructions.

An even further object of the present invention is to provide a new and improved glow cup system which is susceptible of a low cost of manufacture with regard to both materials and labor, and which accordingly is then susceptible of low prices of sale to the consuming public, thereby making such glow cup system economically available to the buying public.

Even still another object of the present invention is to provide a glow cup system for illuminating cups for providing an attractive appearance.

Lastly, it is an object of the present invention to provide a new and improved glow cup system having an inner cup with an outwardly extending lip adjacent its open top and a circular base adjacent its closed bottom with an upwardly extending recess, an outer cup coupled to an outwardly extending lip of the inner cup, a first chemiluminescent fluid is retained within an enclosed space formed between the inner and outer cups, a first chemiluminescent fluid adapted to be retained within the enclosed space, and an ampule containing a second chemiluminescent fluid is positioned within the enclosed space adjacent to the recess in the closed bottom of the inner cup.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom view taken along line 3—3 of FIG. 2.

FIG. 4 is a cross-sectoinal view taken along line 4—4 of FIG. 3.

The same reference numerals refer to the same parts throughout the various Figures.

DESCRIPTION OF THE PREFERRED EMBODIMENT

Figure 1:
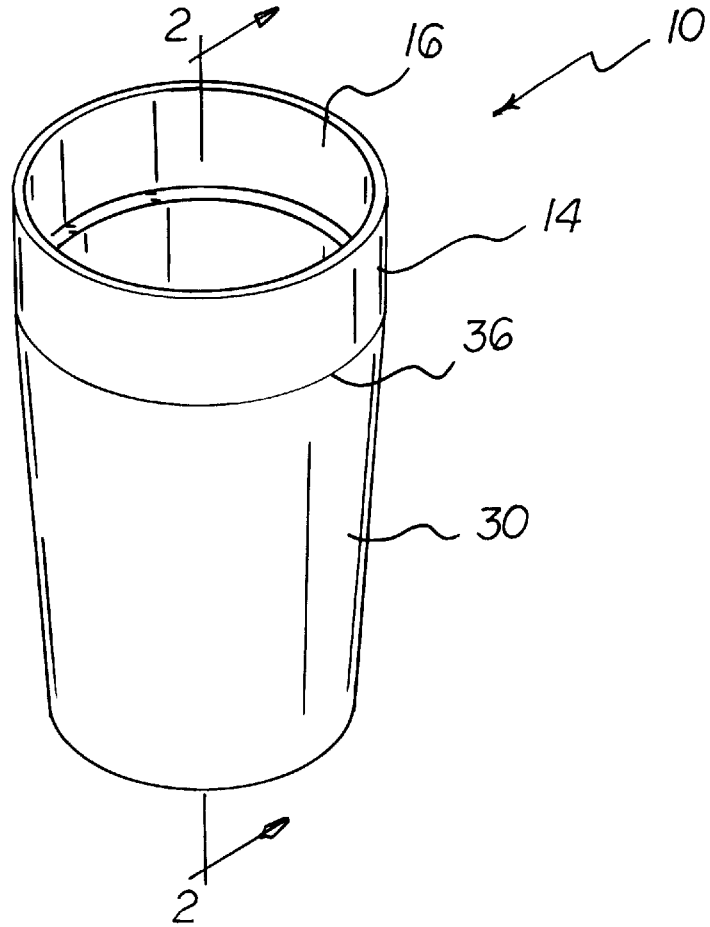
FIG. 1 is a perspective illustration of an improved glow cup system constructed in accordance with the principles of the present invention.
Figure 2:
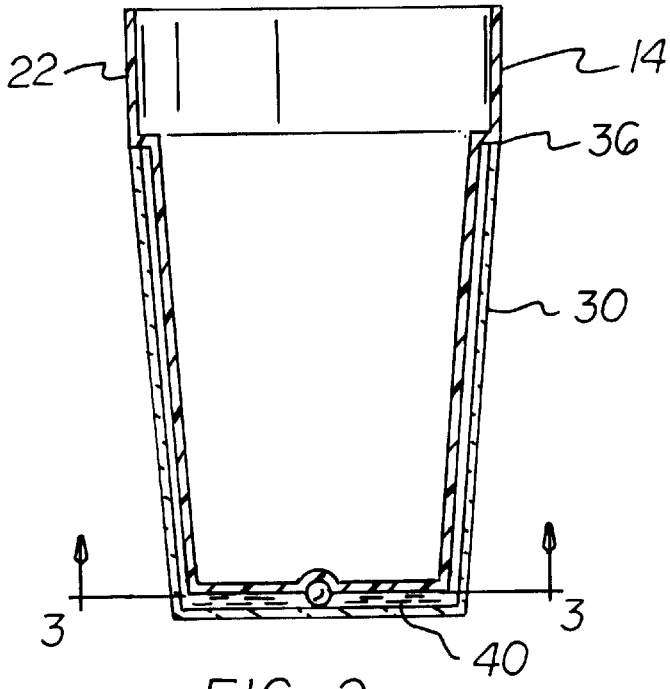
FIG. 2 is a cross sectional view taken along line 2—2 of FIG. 1.
Figure 5:
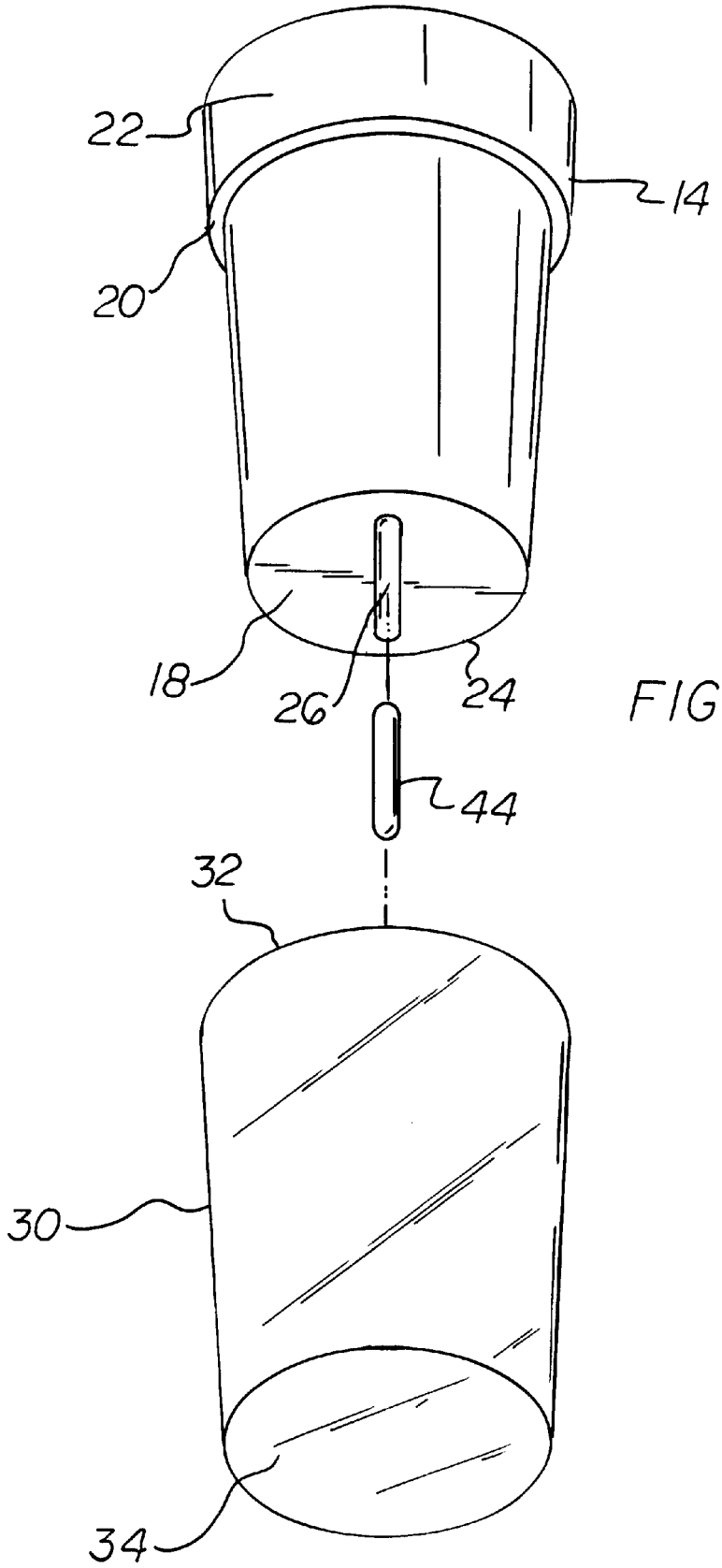
FIG. 5 is an exploded perspective view of the system of the prior figures.

With reference now to the drawings, and in particular to FIG. 1 thereof, the preferred embodiment of the new and improved glow cup system embodying the principles and concepts of the present invention and generally designated by the reference numeral 10 will be described.

The present invention, the glow cup system 10 is comprised of a plurality of components. Such components in their broadest context include an inner cup, an outer cup, a first chemiluminescent fluid and an ampule. Such components are individually configured and correlated with respect to each other so as to attain the desired objective.

First provided is a generally cylindrical inner cup 14 with flexibility. The inner cup has an open top 16 and a closed bottom 18. The inner cup also has an outwardly extending lip 20 adjacent the open top. An upwardly extending cylindrical exterior portion 22 adjacent to the outwardly extending lip forms the open top. A circular base 24 defining the closed bottom has an upwardly extending recess 26. The recess is in a latitudinal semi-cylindrical configuration.

Next provided is a generally cylindrical outer cup 30 with limited flexibility. The outer cup has an open top 32 and a closed bottom 34. The open top is coupled to the outwardly extending lip of the inner cup thereby forming an area of coupling 36 between the inner cup and the outer cup being out of contact with liquid supported in the cup. The coupling is selected from the class of permanent couplings including a spin weld, sonic weld and adhesive. The outer cup is sized with respect to the inner cup to define an enclosed space between the inner and outer cups.

A first chemiluminescent fluid 40 is next provided. The first chemiluminescent fluid is adapted to be retained within the enclosed space defined by the combination of the inner cup and the outer cup.

Next, a cylindrically shaped ampule 44 is provided. The ampule is positioned within the enclosed space adjacent to the recess in the closed bottom of the inner cup. The ampule contains a second chemiluminescent fluid 46. When the ampule is broken by compression of the outer cup on the ampule, the second chemiluminescent fluid will mix with the first chemiluminescent fluid producing a glowing chemiluminescent reaction.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A glow cup system for illuminating a drinking cup thereby increasing its safety comprising, in combination:

a generally cylindrical inner cup with flexibility having an open top and a closed bottom, the inner cup having an outwardly extending lip adjacent the open top, and an upwardly extending cylindrical exterior portion adjacent to the outwardly extending lip and forming the open top, and a circular base defining the closed bottom with an upwardly extending recess having a latitudinal semi-cylindrical configuration;

a generally cylindrical outer cup with limited flexibility having an open top and a closed bottom with the open top being coupled with the outwardly extending lip of the inner cup thereby forming an area of coupling between the inner cup and the outer cup being out of contact with liquid supported in the inner cup, the coupling being selected from the class of permanent couplings including a spin weld, sonic weld and adhesive, the outer cup being sized with respect to the inner cup to define an enclosed space between the inner and outer cups;

a first chemiluminescent fluid adapted to be retained within the enclosed space defined by the combination of the inner cup and the outer cup;

a cylindrically shaped linear ampule positioned between the bottom of the inner cup and the bottom of the outer cup and within the enclosed space adjacent to the recess in the closed bottom of the inner cup and having a second chemiluminescent fluid therein, such that when the ampule is broken by compression of the outer cup on the ampule the second chemiluminescent fluid will mix with the first chemiluminescent fluid producing a glowing chemiluminescent reaction.

2. A glow cup system comprising:

an inner cup having an open top and a closed bottom, the inner cup having an outwardly extending lip adjacent the open top, and a circular base defining the closed bottom with an upwardly extending recess;

an outer cup having an open top and a closed bottom with the open top being coupled with the outwardly extending lip of the inner cup thereby forming an area of coupling between the inner cup and the outer cup, the outer cup being sized with respect to the inner cup to define an enclosed space between the inner and outer cups;

a first chemiluminescent fluid adapted to be retained within the enclosed space;

a linear ampule in a cylindrical configuration between the bottom of the inner cup and the bottom of the outer cup and positioned within the enclosed space adjacent to the recess in the closed bottom of the inner cup and having a second chemiluminescent fluid.

3. The glow cup system as set forth in claim 2 and further including an upwardly extending exterior portion adjacent to the outwardly extending lip.

4. The glow cup system as set forth in claim 2 wherein the recess is of a semi cylindrical configuration.

* * * * *